US007598914B2

(12) United States Patent
Chang

(10) Patent No.: US 7,598,914 B2
(45) Date of Patent: Oct. 6, 2009

(54) WIDE BAND CO-PLANAR WAVEGUIDE FEEDING CIRCULARLY POLARIZED ANTENNA

(75) Inventor: The-Nan Chang, Taipei (TW)

(73) Assignees: Tatung Company (TW); Tatung University (TW)

( * ) Notice: Subject to any disclaimer, the term of this patent is extended or adjusted under 35 U.S.C. 154(b) by 0 days.

(21) Appl. No.: 12/061,817

(22) Filed: Apr. 3, 2008

(65) Prior Publication Data

US 2009/0073074 A1 Mar. 19, 2009

(30) Foreign Application Priority Data

Sep. 14, 2007 (TW) ..... 96134566 A

(51) Int. Cl.
*H01Q 1/38* (2006.01)
*H01Q 9/16* (2006.01)

(52) U.S. Cl. ..... 343/700 MS; 343/822

(58) Field of Classification Search ..... None
See application file for complete search history.

(56) References Cited

U.S. PATENT DOCUMENTS

2005/0156787 A1* 7/2005 Myoung et al. ..... 343/700 MS
2006/0066487 A1* 3/2006 Park et al. ..... 343/700 MS
2007/0290926 A1* 12/2007 Tseng ..... 343/700 MS
2008/0169982 A1* 7/2008 Mei ..... 343/700 MS

OTHER PUBLICATIONS

T.N. Chang and G.A. Tsai, A wideband coplanar waveguide-fed circularly polarised antenna, IET Microwaves, Antennas & Propagation, Jun. 2008, pp. 343-347, vol. 2 No. 4.

* cited by examiner

*Primary Examiner*—Trinh V Dinh
(74) *Attorney, Agent, or Firm*—Lowe Hauptman Ham & Berner, LLP

(57) ABSTRACT

A wide band co-planar waveguide feeding circularly polarized antenna is disclosed. The wide band co-planar waveguide feeding circularly polarized antenna comprises: a substrate having a surface; a signal feeding unit located on the surface and comprising a feeding bar, a matching portion, a first extended portion, and a second extended portion; a first ground unit located on the surface and having a first ground bar; and a second ground unit located on the surface and having a second ground bar; wherein, the first extended portion and the second extended portion are respectively extended from the matching portion. Besides, the matching portion is electrically connected with the feeding bar, the first extended portion and the second extended portion. Moreover, the feeding bar is located between the first ground bar and the second ground bar.

19 Claims, 16 Drawing Sheets

WIDE BAND CO-PLANAR WAVEGUIDE FEEDING CIRCULARLY POLARIZED ANTENNA

RELATED APPLICATIONS

The present application is based on, and claims priority from, Taiwan Application Number 096134566, filed Sep. 14, 2007, the disclosure of which is hereby incorporated by reference herein in its entirety.

BACKGROUND OF THE INVENTION

1. Field of the Invention

This invention relates to a wide band co-planar waveguide circularly polarized antenna capable of operating as a two-way radiation unit without a ground plate, or as a one-way radiation unit with a ground plate. As the antenna is being operated as a one-way radiation unit, the distance between the ground plate and the antenna body thereof can be reduced to 0.125 times of the wavelength of the signal transmitted or received by the antenna, which is smaller than the distance between the ground plate and the antenna body of a conventional antenna (which is 0.25 times of the wavelength of the signal transmitted or received by the conventional antenna). Therefore, while the wide band co-planar waveguide circularly polarized antenna of the present invention operates at a millimeter frequency band and as a one-way radiation unit, the size of the antenna can be further reduced so as to be packaged on a printed circuit board, along with a signal processor.

2. Description of Related Art

FIG. 1A is a schematic view illustrating the conventional wide band hole antenna, which comprises a substrate 11, an electric conductive plate 12, and a ground plate 13. The electric conductive plate 12 is located at one side of the substrate 11 and keeps a predetermined distance from the substrate 11. The ground plate 13 is located at the other side of the substrate 11 opposing the electric conductive plate 12 and integrates with the substrate 11. Further, the electric conductive plate 12 has a hole 121, and a feeding wire 14 sends a signal to the upper surface 122 of the electric conductive plate 12 surrounding the hole 121. FIG. 1B is a cross-section view of the conventional wide band hole antenna, along the I-I' line in FIG. 1A. As shown in the figure, the substrate 11 comprises a plurality of electric conductive portions 112 located on the upper surface 111 of the substrate 11, and the ground plate 13 integrates with the lower surface 113 of the substrate 11. Moreover, each of the aforementioned electric conductive portions 112 is respectively electrically connected with one conductive portion 114, for electrical connection with the ground plate 13.

On the other hand, although the predetermined distance, labeled as D, can be smaller than one-quarter of the wavelength of the signal transmitted or received by the conventional wide band hole antenna, a plurality of electric conductive portions 112 having complex structures and a plurality of conductive portions 114 are required to be added into the conventional wide band hole antenna. Other than the rectangular-shaped hole 121 shown in FIG. 1A, the electric conductive plate 12 of the conventional hole antenna can have holes of any kind of shape, such as spindle-shaped or dumbbell-shaped, etc, which are shown through FIG. 2A to FIG. 2E However, no matter what kind of shape in which the hole is formed on the electric conductive plate, the conventional hole antenna can only transmit or receive a linearly polarized signal.

Therefore, the thickness of the conventional hole antenna cannot be further reduced, resulting in limited application field of the conventional hole antenna. Further, a circularly polarized signal is widely used in the communications application field, in order to prevent the downgrade of the efficiency of the transmission or reception of the high frequency signal by the orientation of the antenna. Therefore, the conventional wide band hole antenna which can only transmit or receive a linearly polarized signal is no longer capable of being considered in the future radio frequency communications application.

As a result, a wide band co-planar waveguide circularly polarized antenna having a reduced thickness and being capable of being packaged into a printed circuit board along with a signal processor is required in the radio frequency communications industry.

SUMMARY OF THE INVENTION

This present invention provides a wide band co-planar waveguide circularly polarized antenna capable of operating as a two-way radiation unit or a one-way radiation unit. When the antenna is going to be operated as a one-way radiation unit, a ground plate located below the antenna body is required. Besides, the distance between the ground plate and the antenna body is smaller than one-quarter of the wavelength of the high frequency signal transmitted or received by the antenna.

The other object of this present invention is to provide a wide band co-planar waveguide circularly polarized antenna capable of being packaged on a printed circuit board, along with a signal processor.

For achieving the abovementioned object, the wide band co-planar waveguide circularly polarized antenna of the present invention comprises: a substrate having a surface; a signal feeding unit located on the surface and comprising a feeding bar, a matching portion, a first extended portion, and a second extended portion; a first ground unit located on the surface and having a first ground bar; and a second ground unit located on the surface and having a second ground bar; wherein, the first extended portion and the second extended portion are respectively extended from the matching portion. Besides, the matching portion is electrically connected with the feeding bar, the first extended portion and the second extended portion. Moreover, the feeding bar is located between the first ground bar and the second ground bar.

From the abovementioned, as the wide band co-planar waveguide circularly polarized antenna of the present invention is operated as a one-way radiation unit, the distance between the ground plate and the antenna body thereof is 0.1 times of the wavelength of the signal transmitted or received by the antenna, which is smaller than the distance between the ground plate and the antenna body of a conventional antenna. Therefore, while the antenna of the present invention is operated at a millimeter frequency band and as a one-way radiation unit, the size of the antenna can be further reduced so as to be packaged on a printed circuit board, along with a signal processor. To extend its availability, the wide band co-planar waveguide feeding circularly polarized antenna of the present invention is demonstrated/designed to transmit or receive a circularly polarized high frequency signal at two different frequency bands, such as the one ranging from 5.2 GHz to 5.8 GHz (the present RF communication band), and the one ranging from 59 GHz to 64 GHz (the future RF communication band). Consequently, the wide band co-planar waveguide circularly polarized antenna of the present invention can optionally be designed to operate at either the present RF communication band, or the future RF communication band.

The wide band co-planar waveguide feeding circularly polarized antenna of the present invention further comprises a ring portion, wherein the feeding unit, the first ground unit and the second ground unit is surrounded by the ring portion. In the present invention, the ring portion preferably is a rectangular-shaped ring having an opening. But in other operation conditions, the ring portion can also be any other type of ring having an opening, such as a polygonal-shaped ring having an opening, or a square-shaped ring having an opening. In addition, the first extended portion is a vertical extended portion, and the second extended portion is a parallel portion. In the present invention, the first extended portion and the second extended portion are preferably rectangular-shaped portions or square-shaped portions. Moreover, the first extended portion and the second extended portion can both be vertical extended portions, or parallel portions.

The substrate of the wide band co-planar waveguide circularly polarized antenna of the present invention can be made of any kind of material. Preferably, the substrate can be an FR-4 microwave substrate, a Duroid microwave substrate, a Teflon microwave substrate, a Rohacell microwave substrate, a GaAs-based microwave substrate, a ceramic-based microwave substrate, or a silicon-based board. The signal feeding unit, the first ground unit and the second ground unit can respectively be made of any kind of metallic material, and preferably are made of copper, aluminum or gold. Besides, the ground plate can be made of any kind of metallic material, and preferably is made of copper, aluminum, or gold. The wide band co-planar waveguide circularly polarized antenna of the present invention can receive and transmit a high frequency signal at a first frequency band ranging from 5.2 GHz to 5.8 GHz. Optionally, the antenna can also be designed to receive and transmit a high frequency signal at a second frequency band, ranging from 59 GHz to 64 GHz. The distance between the ground plate and substrate of the antenna can be any value, and preferably the distance is smaller than one-quarter of the wavelength of the high frequency signal received or transmitted by the antenna.

Other objects, advantages, and novel features of the invention will become more apparent from the following detailed description when taken in conjunction with the accompanying drawings.

DETAILED DESCRIPTION OF THE PREFERRED EMBODIMENT

Figure 1A:
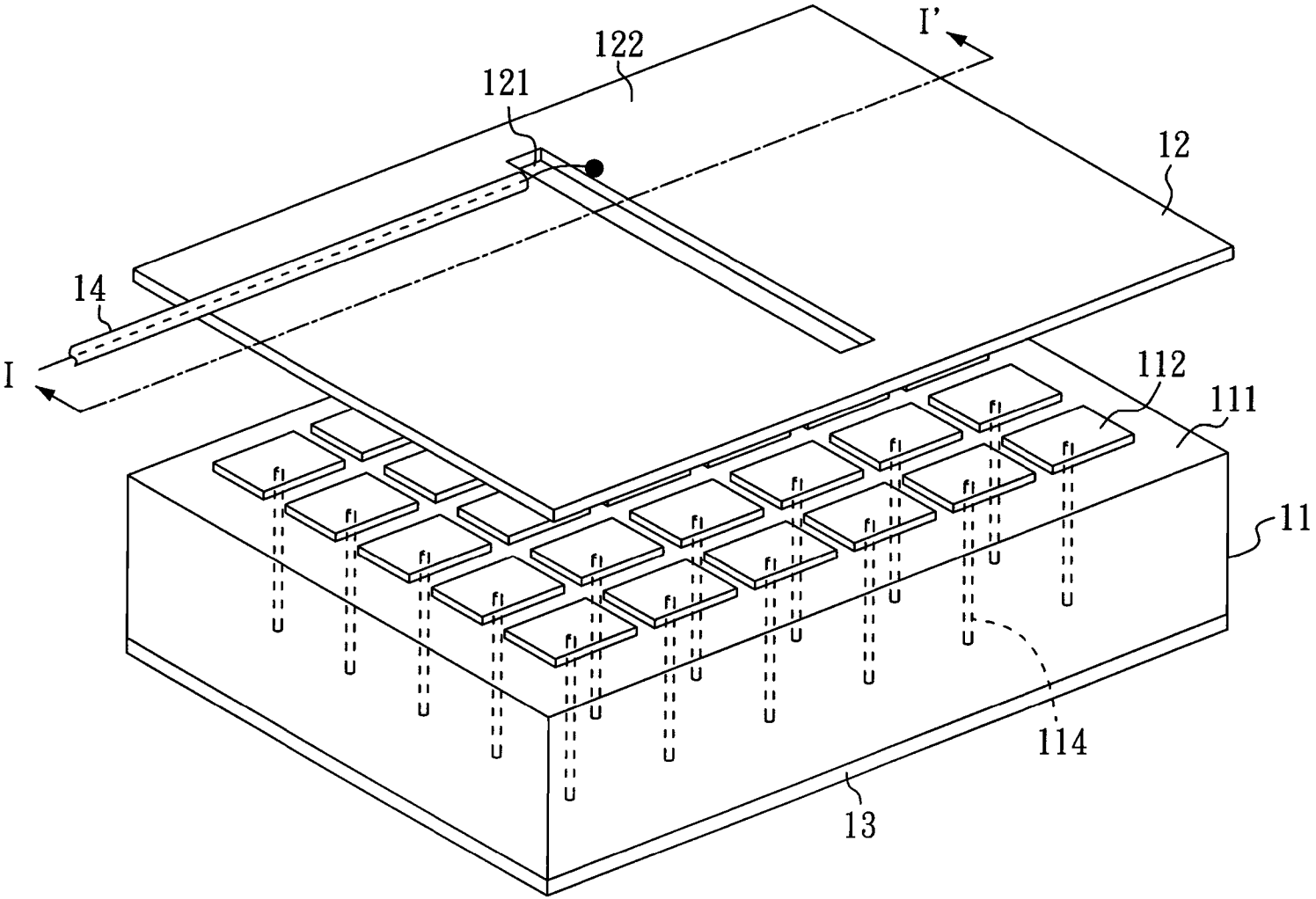
FIG. 1A (Prior Art)
FIG. 1A is a schematic view illustrating the conventional wide band hole antenna.
Figure 1B:
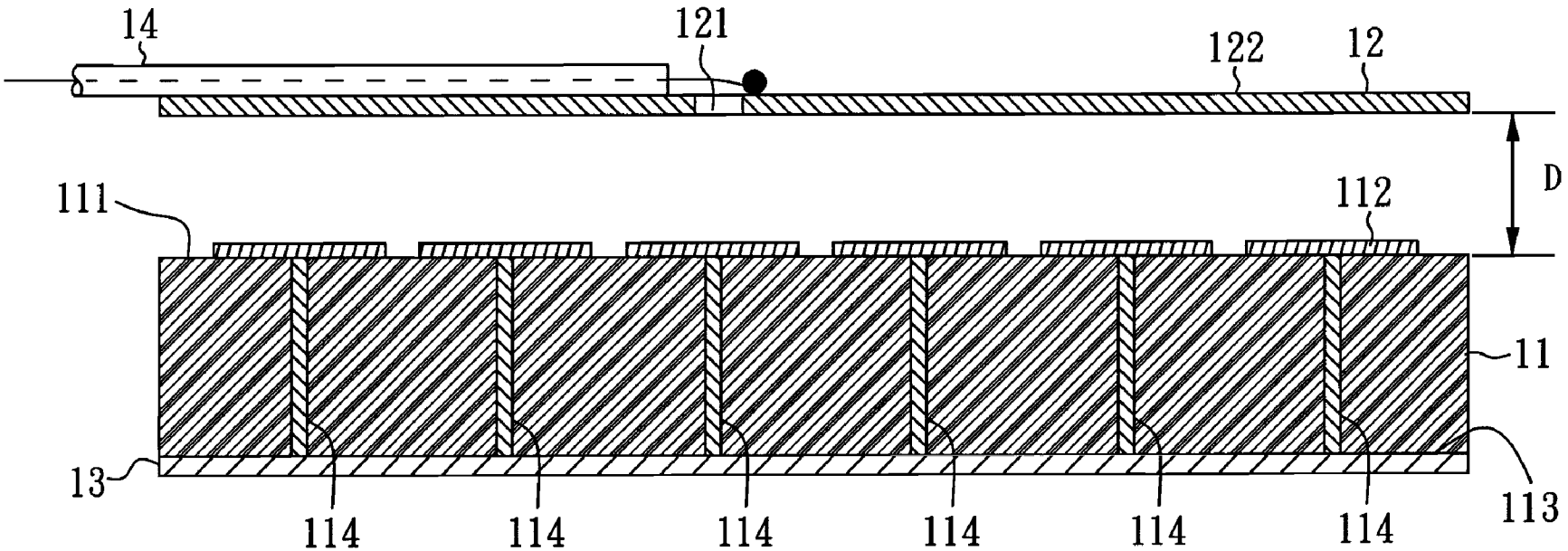
FIG. 1B (Prior Art)
FIG. 1B is a cross-section view of the conventional wide band hole antenna, along with the I-I' line in FIG. 1A.
Figure 2A:
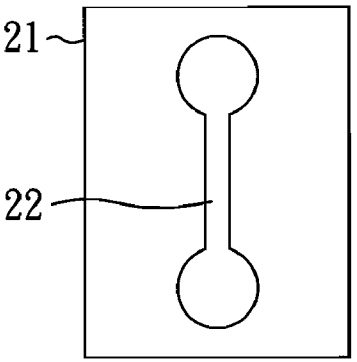
FIG. 2A(Prior Art)
FIGS. 2A to 2F are schematic views illustrating the holes formed on the conductive plate of the conventional wide band hole antenna.
Figure 2B:
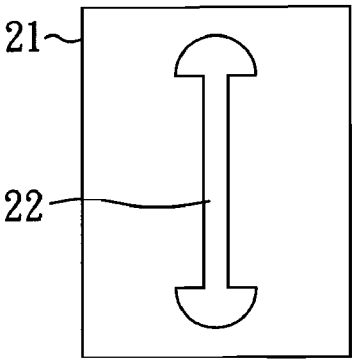
FIG. 2B(Prior Art)
Figure 2C:
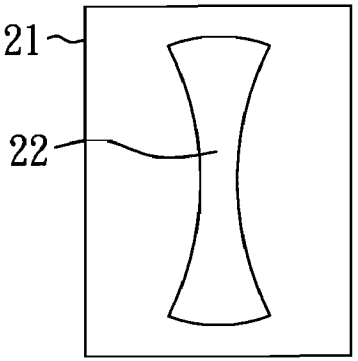
FIG. 2C(Prior Art)
Figure 2D:
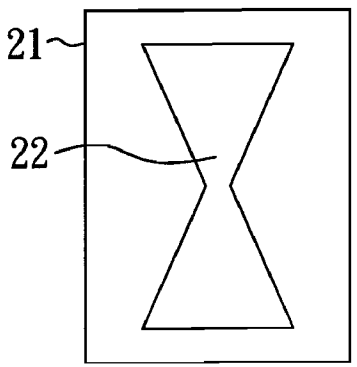
FIG. 2D(Prior Art)
Figure 2E:
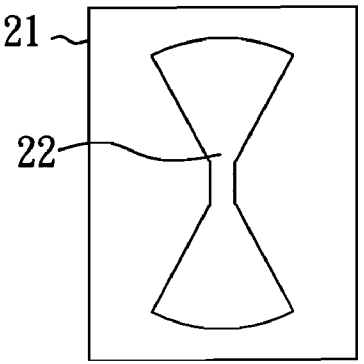
FIG. 2E(Prior Art)
Figure 2F:
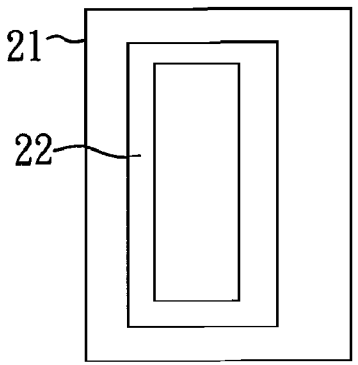
FIG. 2F(Prior Art)
Figure 3A:
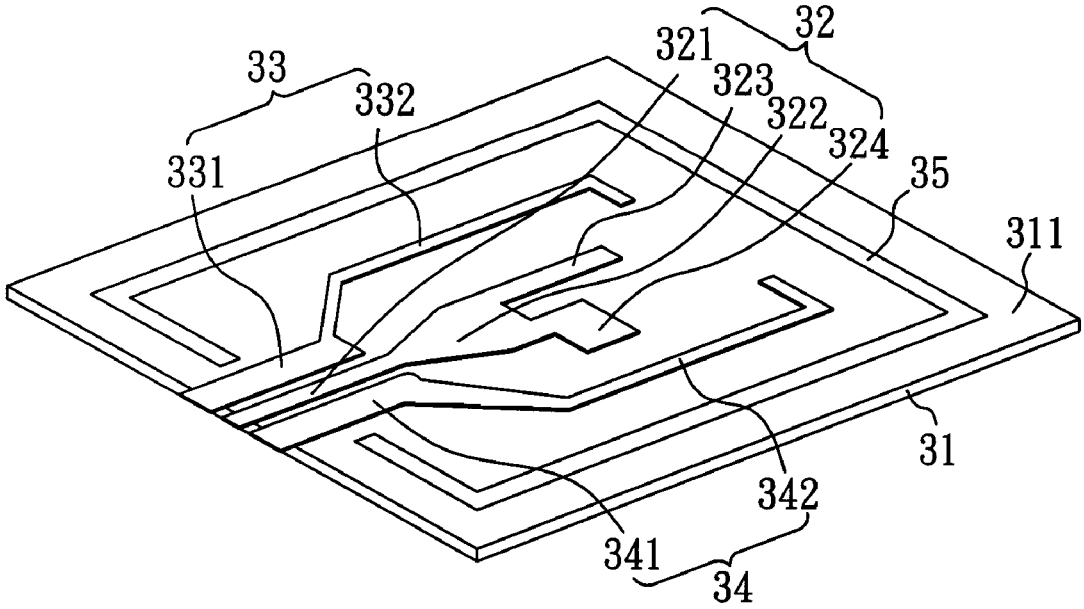
FIG. 3A is a schematic view illustrating the wide band co-planar waveguide circularly polarized antenna, according to the first preferred embodiment of the present invention.

FIG. 3A is a schematic view illustrating the wide band co-planar waveguide circularly polarized antenna, according to the first preferred embodiment of the present invention. The antenna comprises a substrate 31, a signal feeding unit 32, a first ground unit 33, and a second ground unit 34, wherein the signal feeding 32, the first ground unit 33 and the second ground unit 34 are respectively located at a surface 311 of the substrate 31. In the present embodiment, the substrate 31 is an FR-4 microwave substrate having a dielectric constant of 4.4 and a thickness of 1.6 mm. But in other operation conditions, the substrate 31 can be made of any kind of materials. Preferably, the substrate 31 can also be a Duroid microwave substrate, a Teflon microwave substrate, a Rohacell microwave substrate, a GaAs-based microwave substrate, a ceramic-based microwave substrate, or a silicon-based board.

Further, the signal feeding unit 32 comprises a feeding bar 321, a matching portion 322, a first extended portion 323, and a second extended portion 324, wherein the first extended portion 323 and the second extended portion 324 are respectively extended from the matching portion 322. The matching portion 322 is electrically connected with the feeding bar 321, the first extended portion 323, and the second extended portion 324. Besides, the feeding bar 321 is electrically connected with a signal processor (not shown). In addition, the first extended portion 323 is a vertical extended portion, and the second extended portion 324 is a parallel portion. In the present embodiment, the first extended portion 323 and the second extended portion 324 are rectangular-shaped portions, but they can have different kinds of shapes in other operation conditions.

Referring to FIG. 3A, the first ground unit 33 includes a first ground bar 331 having a first extended ground portion 332 extended from one end thereof, wherein the first extended ground portion 332 is adjacent to the first extended portion 323 on the surface 311 of the substrate 31. The second ground unit 34 includes a second ground bar 341 having a second extended ground portion 342 extended from one end thereof, wherein the second extended ground portion 342 has the same shape as that of the first extended ground portion 332. In addition, the feeding bar 321 is located between the first ground bar 331 and the second ground bar 341 on the surface 311 of the substrate 31, forming a so-called "co-planar feeding structure". Besides, the matching portion 322, the first extended portion 323 and the second extended portion 324 are located between the first ground portion 332 and the second ground portion 342, and as a result, the signal feeding unit 32 is located between the first ground unit 33 and the second ground unit 34. It should be noted that, although the signal feeding unit 32, the first ground unit 33 and the second ground unit 34 are made of copper in the present embodiment, the signal feeding unit 32, the first ground unit 33 and the second ground unit 34 can still be made of other kinds of metallic material, such as aluminum or gold, in other operation conditions.

Finally, the wide band co-planar waveguide feeding circularly polarized antenna of the present invention further comprises a ring portion 35, wherein the signal feeding unit 32, the first ground unit 33 and the second ground unit 34 are surrounded by the ring portion 35. Although in the present embodiment, the ring portion 35 is a rectangular-shaped ring having an opening, the ring portion 35 can still have other kinds of shape in other operation conditions, such as a polygonal-shaped ring having an opening, or a square-shaped ring having an opening.

Figure 3B:
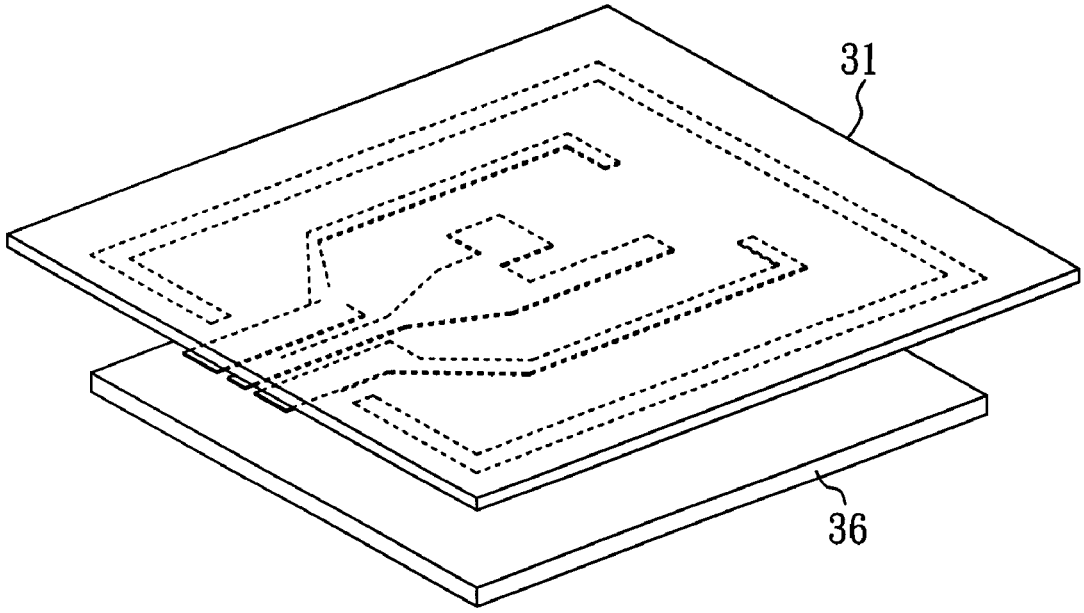
FIG. 3B is a schematic view illustrating the connecting method between the wide band co-planar waveguide circularly polarized antenna shown in FIG. 3A and a ground plate.

Besides, other than the structure shown in FIG. 3A, the wide band co-planar waveguide circularly polarized antenna of the present invention can further comprise a ground plate 36, wherein the signal feeding unit 32, the first ground unit 33 and the second ground unit 34 are located between the substrate 31 and the ground plate 36, as shown in FIG. 3B. By having the ground plate 36, the wide band co-planar waveguide circularly polarized antenna of the present embodiment can only operate as a one-way radiation unit. In addition, the distance between the substrate 31 and the ground plate 36 is 0.5 mm, which is about 0.1 times of the wavelength of the high frequency signal (at a millimeter frequency band) transmitted and received by the wide band co-planar waveguide feeding circularly polarized antenna of the present invention. But in different operation conditions, the distance between the substrate 31 and the ground plate 36 can be ranged from 0.05 times to 0.2 times of the wavelength of the aforementioned high frequency signal. In the present embodiment, the ground plate 36 is preferably made of copper, but in other operation conditions, the ground plate 36 can be made of any kind of metallic material, such as aluminum or gold.

Figure 4A:
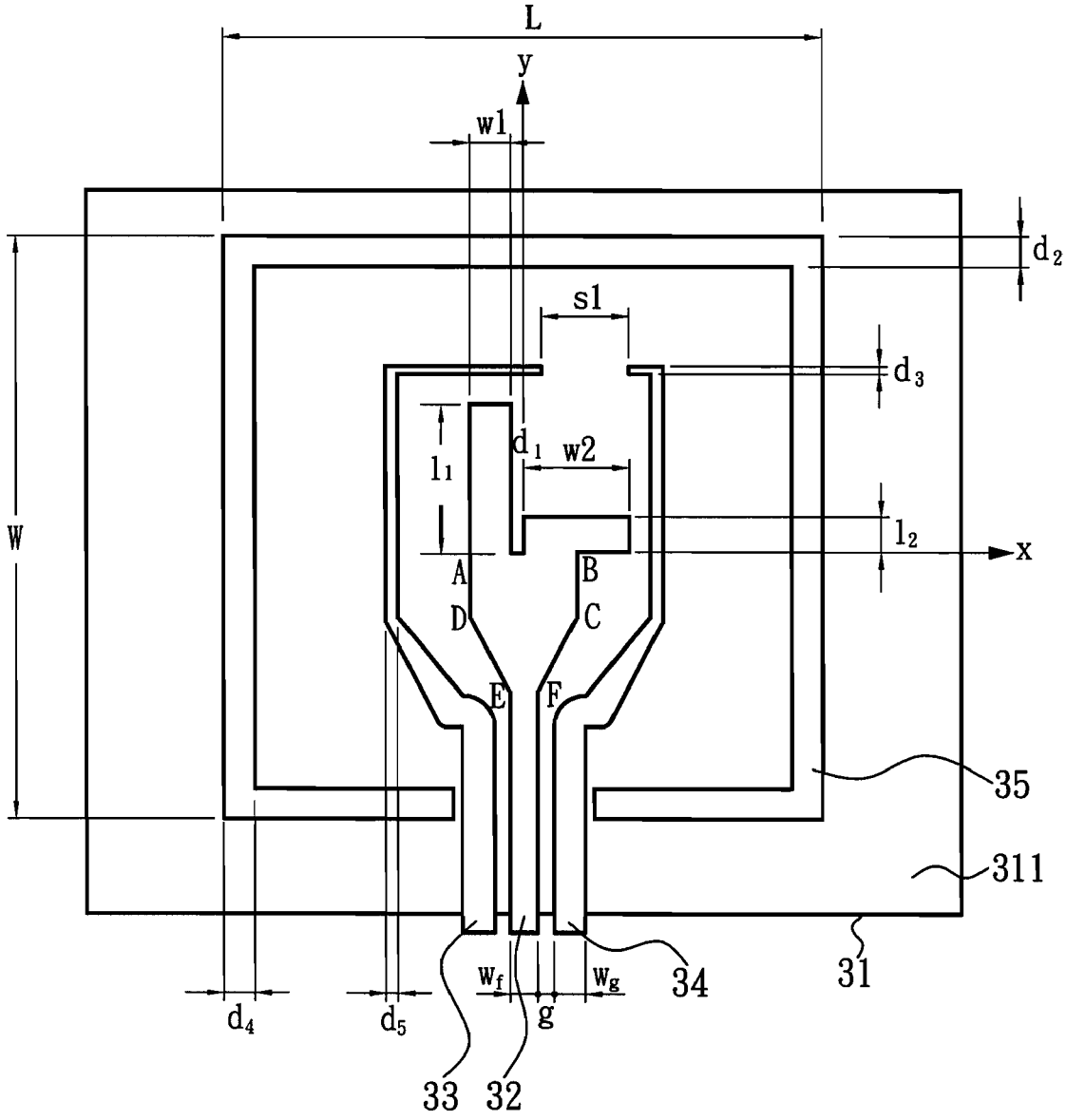
FIG. 4A is an upper view illustrating the wide band co-planar waveguide circularly polarized antenna, according to the first preferred embodiment of the present invention.
Figure 4B:
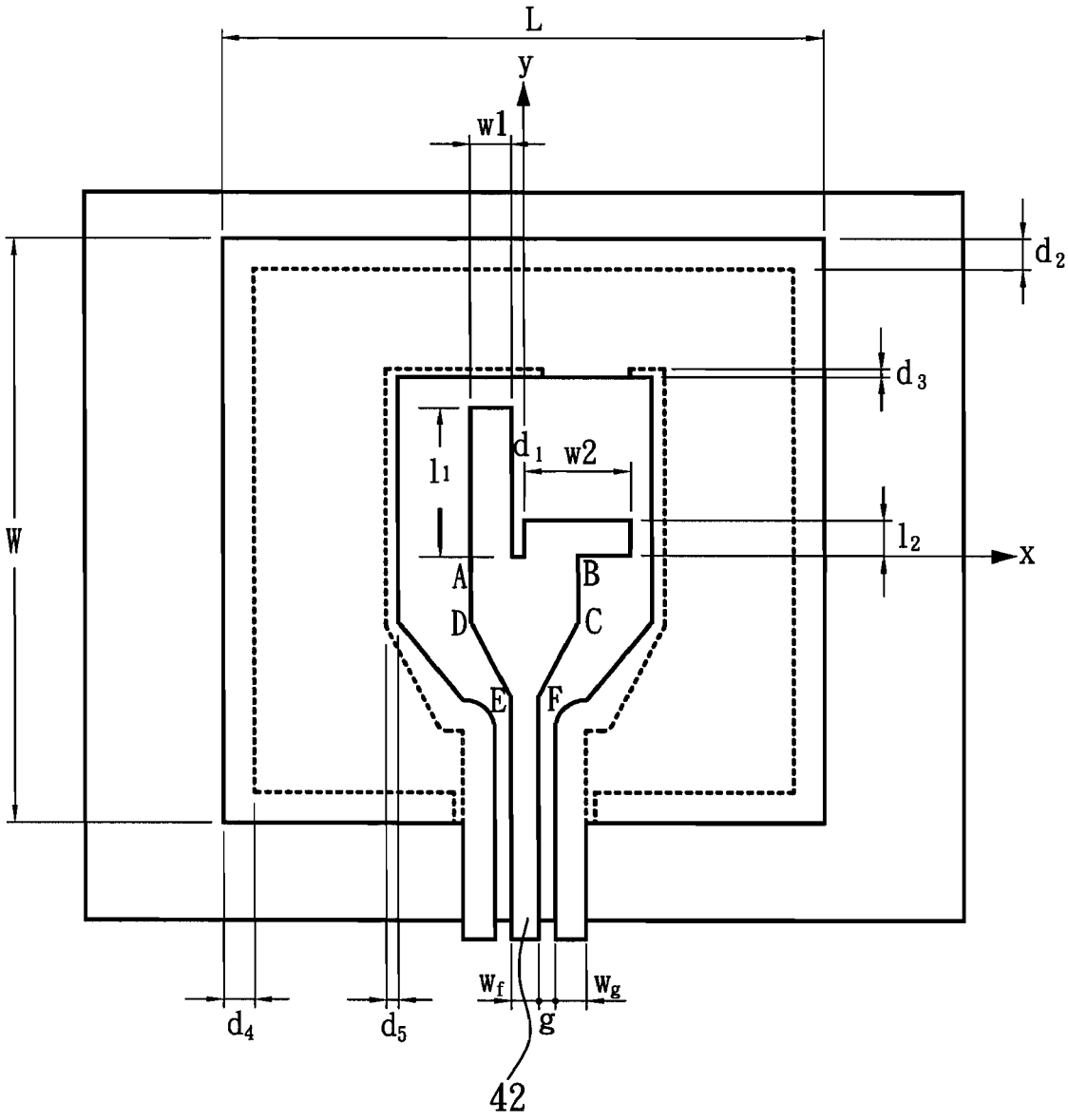
FIG. 4B is an upper view illustrating the wide band co-planar waveguide circularly polarized antenna, according to the second preferred embodiment of the present invention.

FIG. 4A is an upper view illustrating the wide band co-planar waveguide circularly polarized antenna, according to the first preferred embodiment of the present invention. FIG. 4B is an upper view illustrating the wide band co-planar waveguide circularly polarized antenna, according to the second preferred embodiment of the present invention. Beside, the values of the labels corresponding to the size of the wide band co-planar waveguide feeding circularly polarized antenna shown in FIG. 4A, are listed in Table 1 below.

TABLE 1

| Label | Size (mm) | Label | Size (mm) | Label | Size (mm) |
|---|---|---|---|---|---|
| w1 | 6.64 | l1 | 15.64 | w2 | 11.16 |
| l2 | 3.64 | d | 1.35 | d1 | 1.88 |
| d2 | 3 | d3 | 0.5 | d4 | 3 |
| d5 | 1 | wf | 2.5 | wg | 3.8 |
| L | 62 | W | 62 | | |

In addition, the coordinates of the labels corresponding to the shape of the wide band co-planar waveguide feeding circularly polarized antenna shown in FIG. 4A, are listed in Table 2 below.

TABLE 2

| Label | Coordinate | Label | Coordinate |
|---|---|---|---|
| A | (−8.52 mm, 0 mm) | B | (5.52 mm, 0 mm) |
| C | (5.52 mm, −6.59 mm) | D | (−8.52 mm, −6.59 mm) |
| E | (−1.25 mm, −14.83 mm) | F | (1.25 mm, −14.83 mm) |

Further, since the wide band co-planar waveguide feeding circularly polarized antenna according to the second preferred embodiment of the present invention, as shown at the FIG. 4B, is formed by filling the gap between the first ground unit 33 and the second ground unit 34, and the ring portion 35 of the wide band co-planar waveguide feeding circularly polarized antenna according to the first preferred embodiment of the present invention, as shown at the FIG. 4B, the signal feeding unit 42 of the wide band co-planar waveguide feeding circularly polarized antenna according to the second preferred embodiment of the present invention is equivalent to the signal feeding unit 32 of the wide band co-planar waveguide feeding circularly polarized antenna according to the first preferred embodiment of the present invention.

Figure 5A:
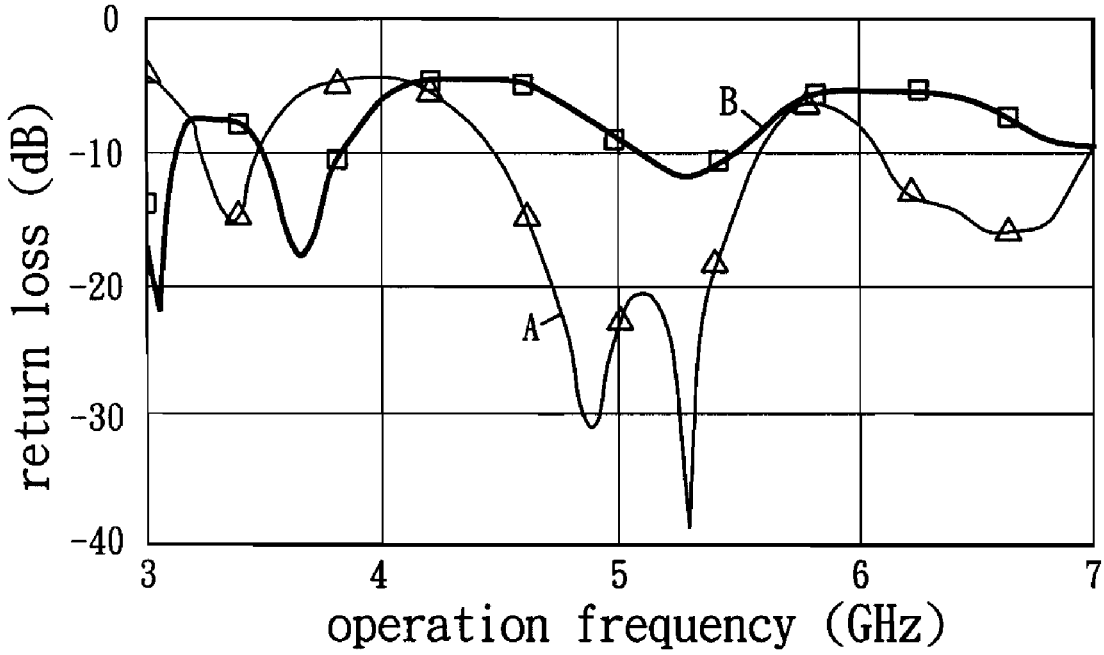
FIG. 5A is a schematic view illustrating the relation between the return loss and the operation frequency of the wide band co-planar waveguide feeding circularly polarized antenna according to the first preferred embodiment, and the second preferred embodiment of the present invention.

FIG. 5A is a schematic view illustrating the relation between the return loss and the operation frequency of the wide band co-planar waveguide feeding circularly polarized antenna according to the first preferred embodiment, and the second preferred embodiment of the present invention, wherein the curves in FIG. 5A are formed by the simulation performed by the IE3D program. The curve A in FIG. 5A illustrates the variation of the return loss regarding the variation of the operation frequency of the wide band co-planar waveguide feeding circularly polarized antenna according to the first preferred embodiment of the present invention. The curve B in FIG. 5A illustrates the variation of the return loss regarding the variation of the operation frequency of the wide band co-planar waveguide feeding circularly polarized antenna according to the second preferred embodiment of the present invention. As shown in FIG. 5A, the 10-dB bandwidth of the loss return of the wide band co-planar waveguide feeding circularly polarized antenna according to the first preferred embodiment is wider than the 10-dB bandwidth of the loss return of the wide band co-planar waveguide feeding circularly polarized antenna according to the second preferred embodiment.

Figure 5B:
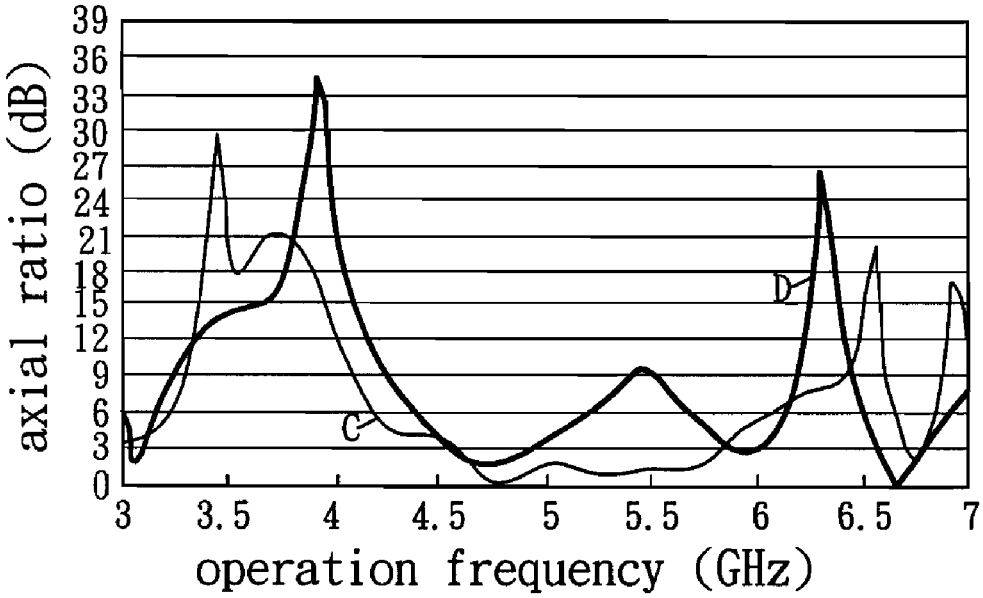
FIG. 5B is a schematic view illustrating the relation between the axial ratio on the main-lobe direction and the operation frequency of the wide band co-planar waveguide feeding circularly polarized antenna according to the first preferred embodiment, and the second preferred embodiment of the present invention.

FIG. 5B is a schematic view illustrating the relation between the axial ratio on the main-lobe direction and the operation frequency of the wide band co-planar waveguide feeding circularly polarized antenna according to the first preferred embodiment, and the second preferred embodiment of the present invention, wherein the curves in FIG. 5B are formed by the simulation performed by the IE3D program. The curve C in FIG. 5B illustrates the variation of the axial ratio on the main-lobe direction regarding the variation of the operation frequency of the wide band co-planar waveguide feeding circularly polarized antenna according to the first preferred embodiment of the present invention. The curve D in FIG. 5B illustrates the variation of the axial ratio on the main-lobe direction regarding the variation of the operation frequency of the wide band co-planar waveguide feeding circularly polarized antenna according to the second preferred embodiment of the present invention. As shown in FIG. 5B, the 3-dB bandwidth of the axial ratio on the main-lobe direction of the wide band co-planar waveguide feeding circularly polarized antenna according to the first preferred embodiment is wider than the 3-dB bandwidth of the axial ratio on the main-lobe direction of the wide band co-planar waveguide feeding circularly polarized antenna according to the second preferred embodiment. Therefore, the wide band co-planar waveguide feeding circularly polarized antenna according to the first preferred embodiment can transmit a circularly polarized high frequency signal in a wider frequency band than the wide band co-planar waveguide feeding circularly polarized antenna according to the second preferred embodiment.

Figure 5C:
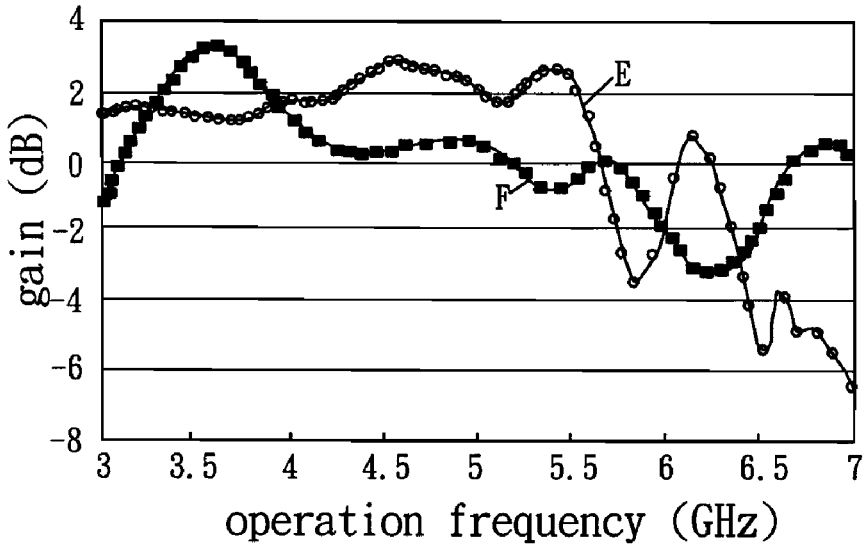
FIG. 5C is a schematic view illustrating the relation between the gain on the main-lobe direction and the operation frequency of the wide band co-planar waveguide feeding circularly polarized antenna according to the first preferred embodiment, and the second preferred embodiment of the present invention.

FIG. 5C is a schematic view illustrating the relation between the gain on the main-lobe direction and the operation frequency of the wide band co-planar waveguide feeding circularly polarized antenna according to the first preferred embodiment, and the second preferred embodiment of the present invention, wherein the curves in FIG. 5C are formed by the simulation performed by the IE3D program. The curve E in FIG. 5C illustrates the variation of the gain on the main-lobe direction regarding the variation of the operation frequency of the wide band co-planar waveguide feeding circularly polarized antenna according to the first preferred embodiment of the present invention. The curve F in the FIG. 5C illustrates the variation of the gain on the main-lobe direction regarding the variation of the operation frequency of the wide band co-planar waveguide feeding circularly polarized antenna according to the second preferred embodiment of the present invention. As shown in FIG. 5C, the gain on the main-lobe direction of the wide band co-planar waveguide feeding circularly polarized antenna according to the first preferred embodiment is higher than the gain on the main-lobe direction of the wide band co-planar waveguide feeding circularly polarized antenna according to the second preferred embodiment, especially in the frequency band ranging from 4 GHz to 5.5 GHz. Therefore, the wide band co-planar waveguide feeding circularly polarized antenna according to the first preferred embodiment can transmit a high frequency signal more efficiently than the wide band co-planar waveguide feeding circularly polarized antenna according to the second preferred embodiment, especially in the frequency band ranging from 4 GHz to 5.5 GHz.

With reference to FIG. 5A, FIG. 5B and FIG. 5C, the wide band co-planar waveguide feeding circularly polarized antenna according to the first preferred embodiment can transmit and receive a circularly polarized high frequency signal in the frequency band ranging from 5.2 GHz to 5.8 GHz. Moreover, after performing certain calculations, the antenna efficiency of the wide band co-planar waveguide feeding circularly polarized antenna according to the first preferred embodiment is 73%, which is higher than the antenna efficiency of the wide band co-planar waveguide feeding circularly polarized antenna according to the second preferred embodiment (65%). The wide band co-planar waveguide feeding circularly polarized antenna according to the second preferred embodiment still has higher signal transmitting efficiency than the conventional antenna, which is only capable of transmitting or receiving a linearly polarized signal.

Figure 5D:
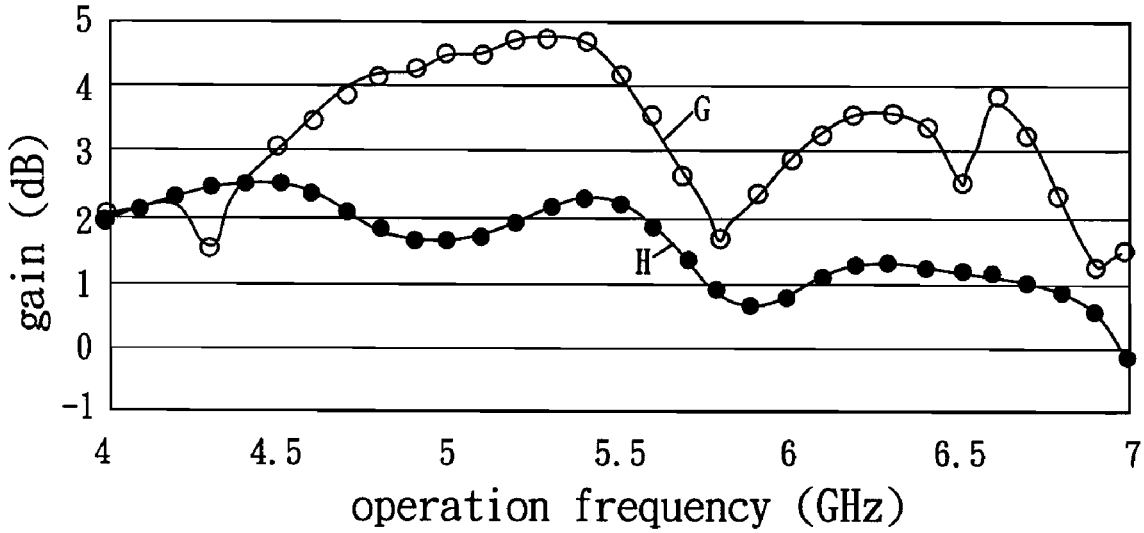
FIG. 5D is a schematic view illustrating the relation between the gain and the operation frequency of the wide band co-planar waveguide feeding circularly polarized antenna according to the first preferred embodiment (with the ring portion), and that of the wide band co-planar waveguide feeding circularly polarized antenna according to the third preferred embodiment (without the ring portion).

FIG. 5D is a schematic view illustrating the relation between the gain and the operation frequency of the wide band co-planar waveguide feeding circularly polarized antenna according to the first preferred embodiment (with ring portion), and that of the wide band co-planar waveguide feeding circularly polarized antenna according to the third preferred embodiment (without the ring portion). In addition, the wide band co-planar waveguide feeding circularly polarized antenna according to the third preferred embodiment has the same structure as the wide band co-planar waveguide feeding circularly polarized antenna according to the first preferred embodiment, except there is no ring portion in the wide band co-planar waveguide feeding circularly polarized antenna according to the third preferred embodiment.

In addition, the curves in FIG. 5D are formed by the simulation performed by the IE3D program. The curve G in FIG. 5D illustrates the variation of the gain regarding the variation of the operation frequency of the wide band co-planar waveguide feeding circularly polarized antenna according to the first preferred embodiment. The curve H in FIG. 5D illustrates the variation of the gain regarding the variation of the operation frequency of the wide band co-planar waveguide feeding circularly polarized antenna according to the third preferred embodiment. As shown in FIG. 5D, since the wide band co-planar waveguide feeding circularly polarized antenna according to the first preferred embodiment has a ring portion, the gain of the wide band co-planar waveguide feeding circularly polarized antenna according to the first preferred embodiment is higher than that of the wide band co-planar waveguide feeding circularly polarized antenna according to the third preferred embodiment. That is, the wide band co-planar waveguide feeding circularly polarized antenna according to the first preferred embodiment can transmit a high frequency signal more efficiently than the wide band co-planar waveguide feeding circularly polarized antenna according to the third preferred embodiment. The wide band co-planar waveguide feeding circularly polarized antenna according to the third preferred embodiment still has higher signal transmitting efficiency than the conventional antenna, which is only capable of transmitting or receiving a linearly polarized signal.

Figure 6A:
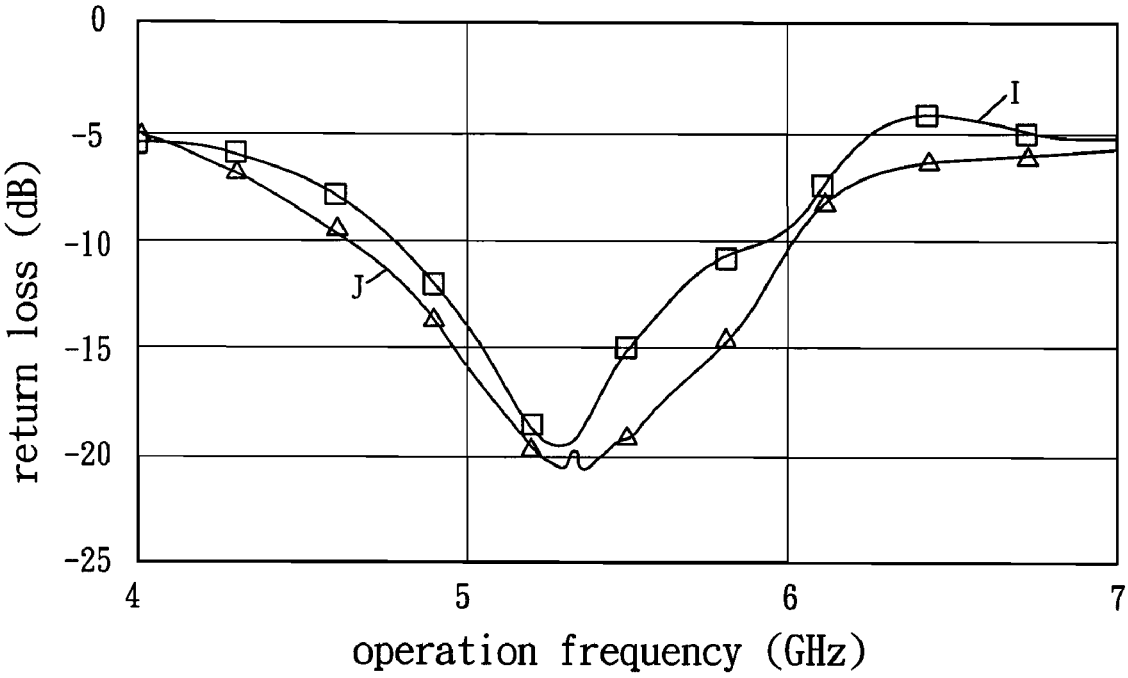
FIG. 6A is a schematic view illustrating the relation between the return loss and the operation frequency of the wide band co-planar waveguide feeding circularly polarized antenna according to the first preferred embodiment of the present invention.

FIG. 6A is a schematic view illustrating the relation between the return loss and the operation frequency of the wide band co-planar waveguide feeding circularly polarized antenna according to the first preferred embodiment of the present invention, wherein curve I is formed by the simulation performed by the IE3D program, and curve J is formed by actually measuring the wide band co-planar waveguide feeding circularly polarized antenna according to the first preferred embodiment. As shown in FIG. 6A, the loss return of the wide band co-planar waveguide feeding circularly polarized antenna according to the first preferred embodiment is below −10 dB, while the operation frequency thereof is in the frequency band ranging from 4.6 GHz to 6 GHz. In the present embodiment, the 10-dB bandwidth of the loss return of the wide band co-planar waveguide feeding circularly polarized antenna according to the first preferred embodiment is about 1.4 GHz.

Figure 6B:
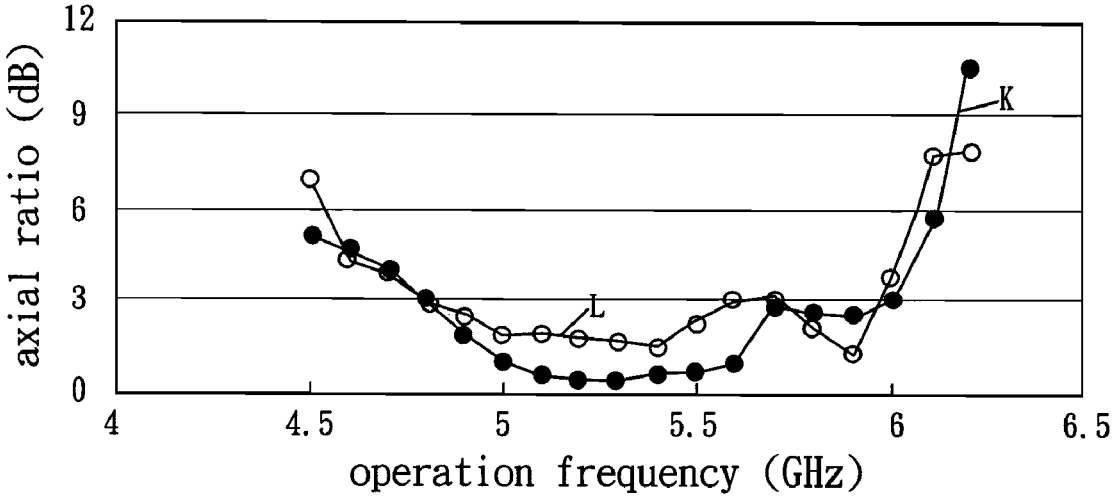
FIG. 6B is a schematic view illustrating the relation between the axial ratio on the main-lobe direction and the operation frequency of the wide band co-planar waveguide feeding circularly polarized antenna according to the first preferred embodiment of the present invention.

FIG. 6B is a schematic view illustrating the relation between the axial ratio on the main-lobe direction and the operation frequency of the wide band co-planar waveguide feeding circularly polarized antenna according to the first preferred embodiment of the present invention, wherein curve K is formed by the simulation performed by the IE3D program, and curve L is formed by actually measuring the wide band co-planar waveguide feeding circularly polarized antenna according to the first preferred embodiment. As shown in FIG. 6B, the axial ratio on the main-lobe direction of the wide band co-planar waveguide feeding circularly polarized antenna according to the first preferred embodiment is below 3 dB, while the operation frequency thereof is in the frequency band ranging from 4.8 GHz to 5.7 GHz. In the present embodiment, the 3-dB bandwidth of the axial ratio on the main-lobe direction of the wide band co-planar waveguide feeding circularly polarized antenna according to the first preferred embodiment is about 0.9 GHz.

Figure 6C:
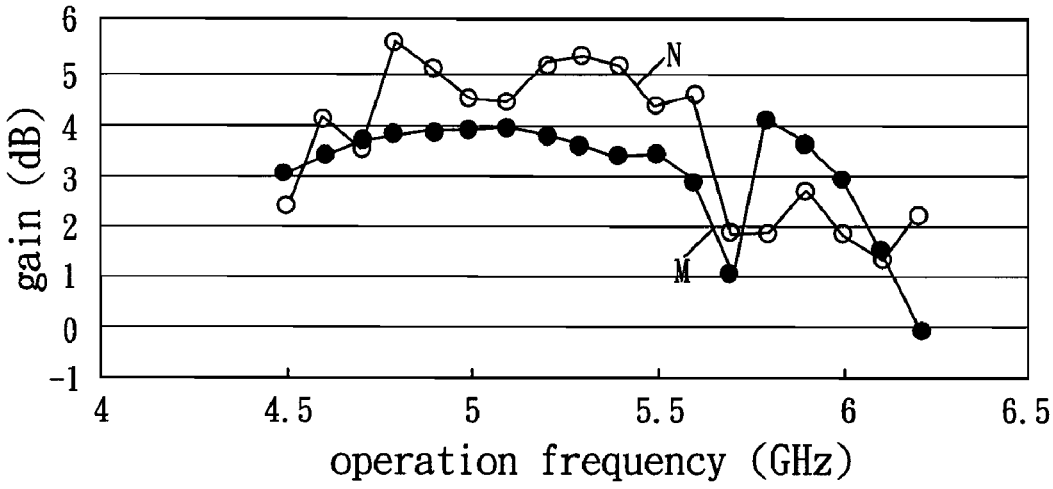
FIG. 6C is a schematic view illustrating the relation between the gain on the main-lobe direction and the operation frequency of the wide band co-planar waveguide feeding circularly polarized antenna according to the first preferred embodiment of the present invention.

FIG. 6C is a schematic view illustrating the relation between the gain on the main-lobe direction and the operation frequency of the wide band co-planar waveguide feeding circularly polarized antenna according to the first preferred embodiment of the present invention, wherein curve M is formed by the simulation performed by the IE3D program, while curve N is formed by actually measuring the wide band co-planar waveguide feeding circularly polarized antenna according to the first preferred embodiment. As shown in FIG. 6C, the axial ratio on the main-lobe direction of the wide band co-planar waveguide feeding circularly polarized antenna according to the first preferred embodiment has a gain on the main-lobe direction larger than 2 dB, while the operation frequency thereof is in the frequency band ranging from 4.5 GHz to 6 GHz.

Figure 6D:
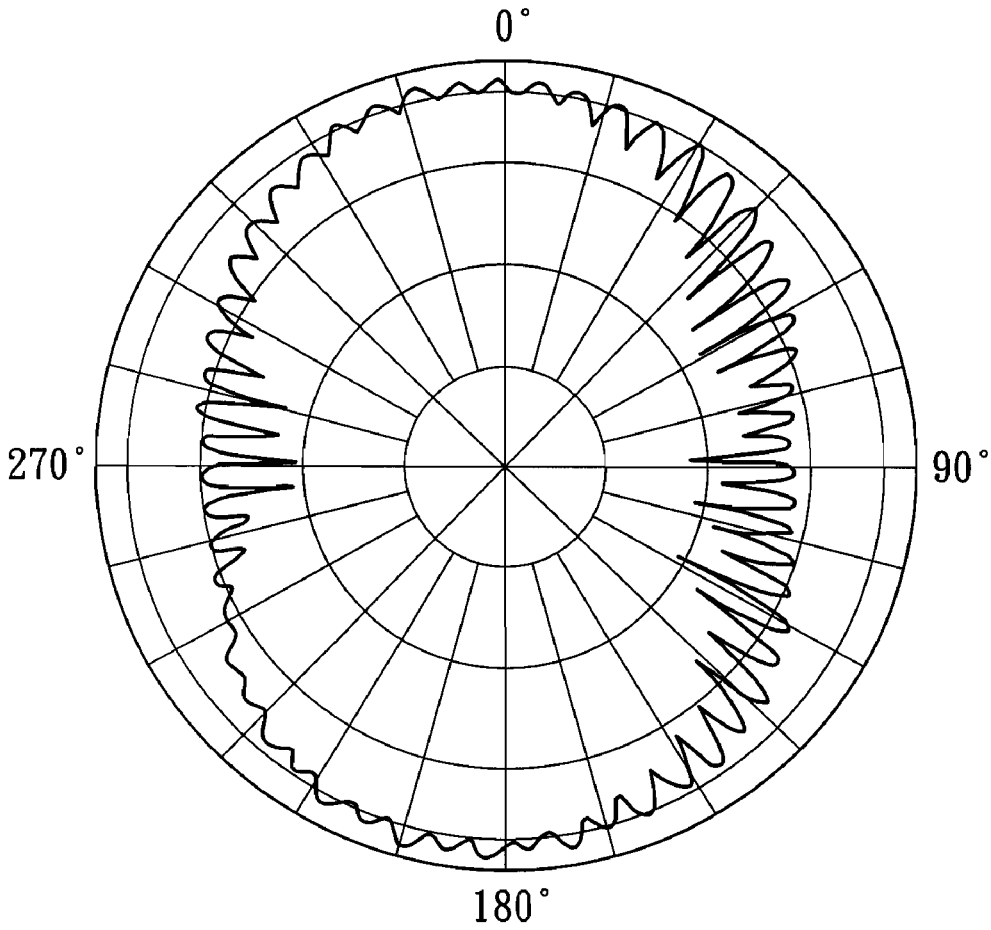
FIG. 6D is a schematic view illustrating the CP pattern of the wide band co-planar waveguide feeding circularly polarized antenna according to the first preferred embodiment of the present invention.

FIG. 6D is a schematic view illustrating the CP pattern of the wide band co-planar waveguide feeding circularly polarized antenna according to the first preferred embodiment of the present invention, which is formed by actually measuring the wide band co-planar waveguide feeding circularly polarized antenna at the operation frequency 5.2 GHz. As shown in FIG. 6D, the wide band co-planar waveguide feeding circularly polarized antenna according to the first preferred embodiment indeed can transmit or receive a circularly polarized high frequency signal.

Figure 7:
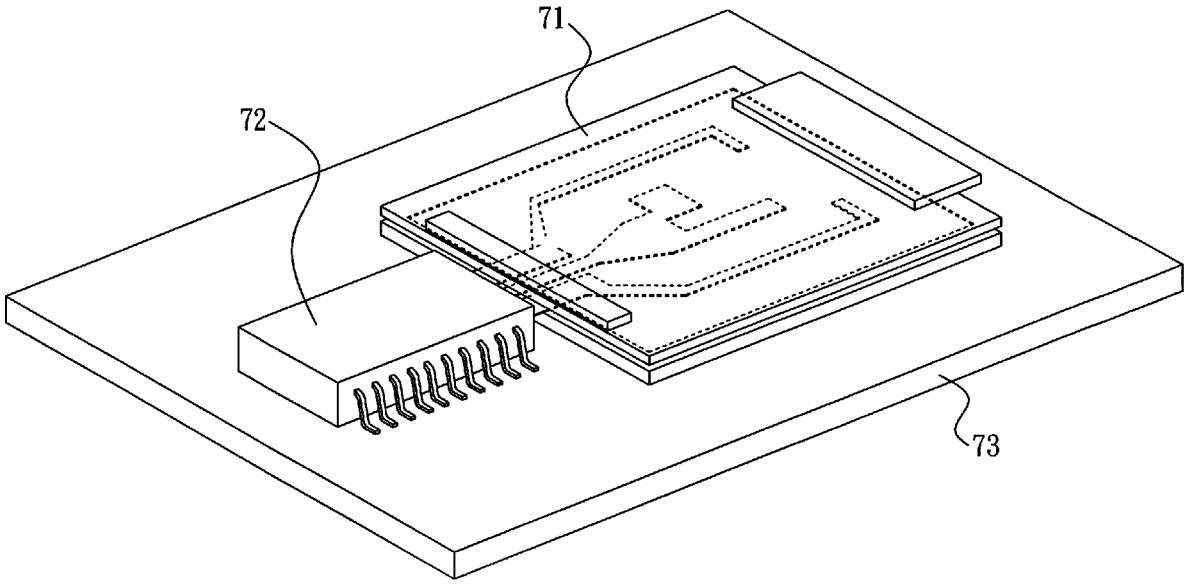
FIG. 7 is a schematic view illustrating the wide band co-planar waveguide feeding circularly polarized antenna according to the first preferred embodiment being packaged into a printed circuit board, along with a signal processing unit.

FIG. 7 is a schematic view illustrating the wide band co-planar waveguide feeding circularly polarized antenna according to the first preferred embodiment being packaged into a printed circuit board, along with a signal process unit. For brevity, the package material covering the wide band co-planar waveguide feeding circularly polarized antenna 71, the signal process unit 72, and the print circuit board 73 are not shown in the figure.

Figure 8A:
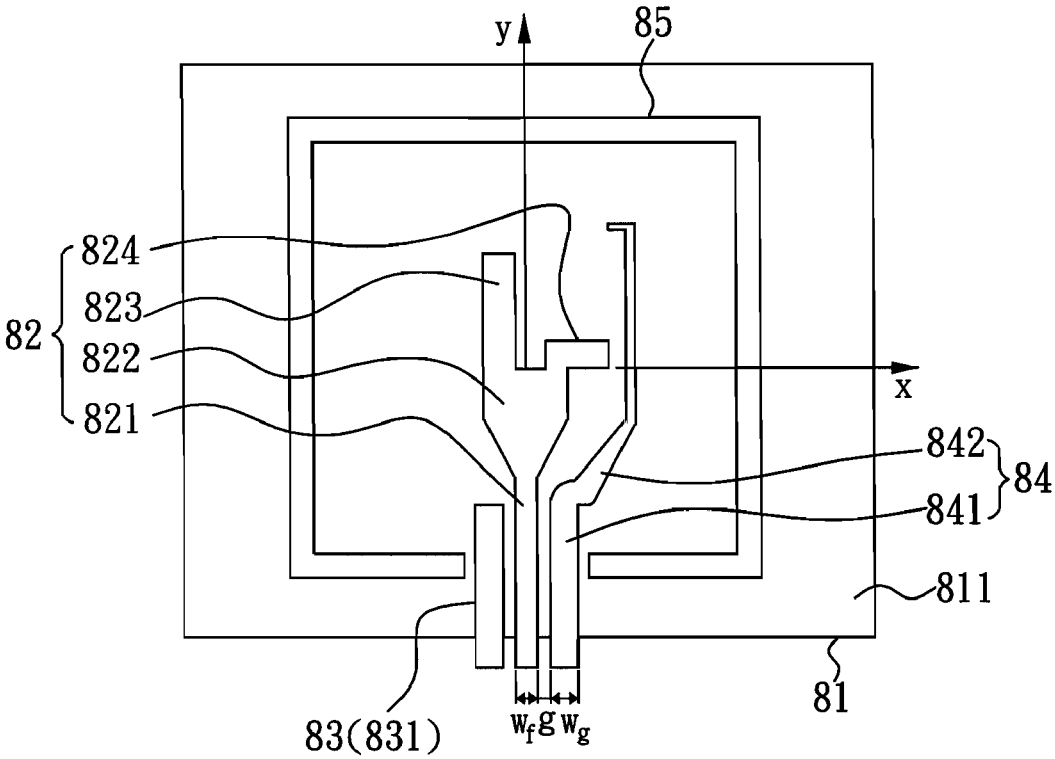
FIG. 8A is an upper view illustrating the wide band co-planar waveguide circularly polarized antenna, according to the fourth preferred embodiment of the present invention.

As shown in FIG. 8A, the wide band co-planar waveguide feeding circularly polarized antenna according to the fourth preferred embodiment has a similar structure as the wide band co-planar waveguide feeding circularly polarized antenna according to the first preferred embodiment. The antenna comprises a substrate 81, a signal feeding unit 82, a first ground unit 83, and a second ground unit 84, wherein the signal feeding 82, the first ground unit 83 and the second ground unit 84 are respectively located on a surface 811 of the substrate 81. In the present embodiment, the substrate 81 is an FR-4 microwave substrate having a dielectric constant of 4.4 and a thickness of 1.6 mm. But in other operation conditions, the substrate 81 can be made from any kind of material. Preferably, the substrate 81 can also be a Duroid microwave substrate, a Teflon microwave substrate, a Rohacell microwave substrate, a GaAs-based microwave substrate, a ceramic-based microwave substrate, or a silicon-based board.

Further, the signal feeding unit 82 comprises a feeding bar 821, a matching portion 822, a first extended portion 823, and a second extended portion 824, wherein the first extended portion 823 and the second extended portion 824 are respectively extended from the matching portion 822. The matching portion 822 is electrically connected with the feeding bar 821, the first extended portion 823, and the second extended portion 824. Besides, the feeding bar 821 is electrically connected with a signal processor (not shown). In addition, the first extended portion 823 is a vertical extended portion, and the second extended portion 824 is a parallel portion. In the present embodiment, the first extended portion 823 and the second extended portion 824 are rectangular-shaped portions, but they can have different kinds of shapes in other operation conditions, such as polygonal-shape, or square-shape.

Referring to FIG. 8A, the first ground unit 83 includes a first ground bar 831. The second ground unit 84 includes a second ground bar 841 having a second extended ground portion 842 extended from one end thereof, wherein the second extended ground portion 842 is adjacent to the second extended portion 824 on the surface 811 of the substrate 81. In addition, the feeding bar 821 is located between the first ground bar 831 and the second ground bar 841 on the surface 311 of the substrate 31, forming a so-called "co-planar feeding structure". Besides, the signal feeding unit 82 is located between the first ground unit 83 and the second ground unit 84. It should be noted that, although the signal feeding unit 82, the first ground unit 83 and the second ground unit 84 are made of copper in the present embodiment, the signal feeding unit 82, the first ground unit 83 and the second ground unit 84 can still be made of other kinds of metallic material, such as aluminum or gold, in other operation conditions.

Finally, the wide band co-planar waveguide feeding circularly polarized antenna of the present invention further comprises a ring portion 85, wherein the signal feeding unit 82, the first ground unit 83 and the second ground unit 84 are surrounded by the ring portion 85. Although in the present embodiment the ring portion 85 is a rectangular-shaped ring having an opening, the ring portion 85 can still have other kinds of shape in other operation conditions, such as a polygonal-shaped ring having an opening, or a square-shaped ring having an opening.

Figure 8B:
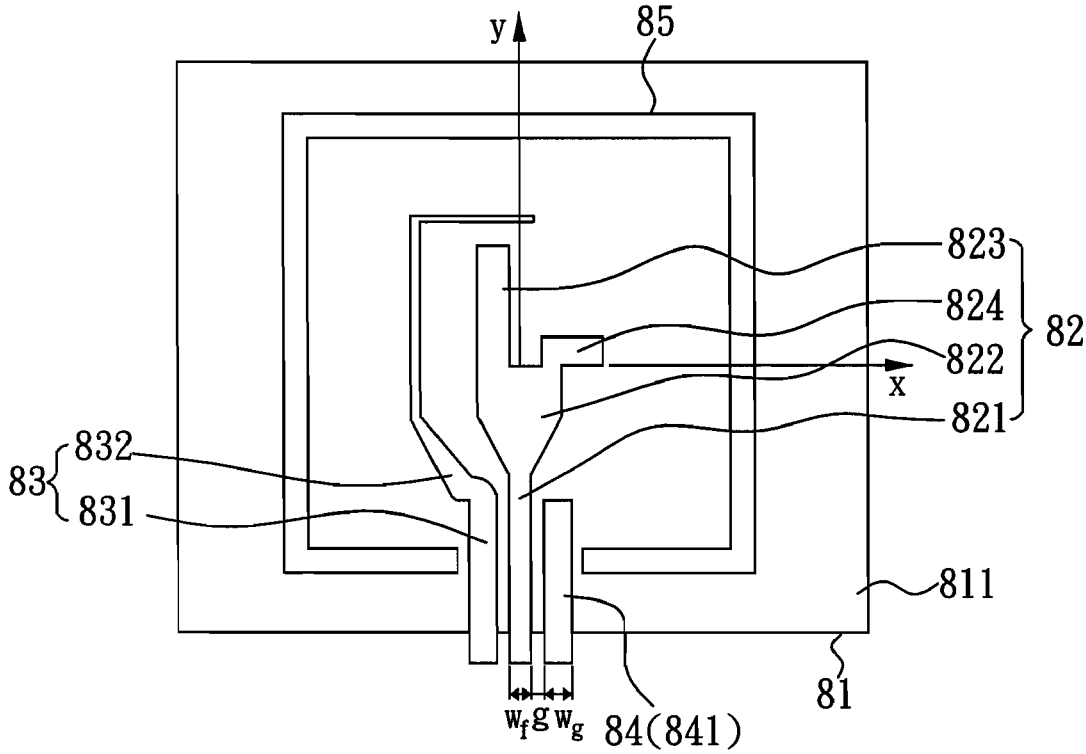
FIG. 8B is an upper view illustrating the wide band co-planar waveguide circularly polarized antenna, according to the fifth preferred embodiment of the present invention.

Referring to FIG. 8B, the structure of the wide band co-planar waveguide feeding circularly polarized antenna according to the fifth preferred embodiment is similar to the structure of the wide band co-planar waveguide feeding circularly polarized antenna according to the fourth preferred embodiment, except for the shapes of the first ground unit 83 and the second ground unit 84. In the wide band co-planar waveguide feeding circularly polarized antenna according to the fifth preferred embodiment, the first ground unit 83 includes a first ground bar 831 having a first extended ground portion 832 extended from one end thereof, wherein the first extended ground portion 832 is adjacent to the first extended portion 823 on the surface 811 of the substrate 81. Besides, the second ground unit 84 includes a second ground bar 841.

Figure 8C:
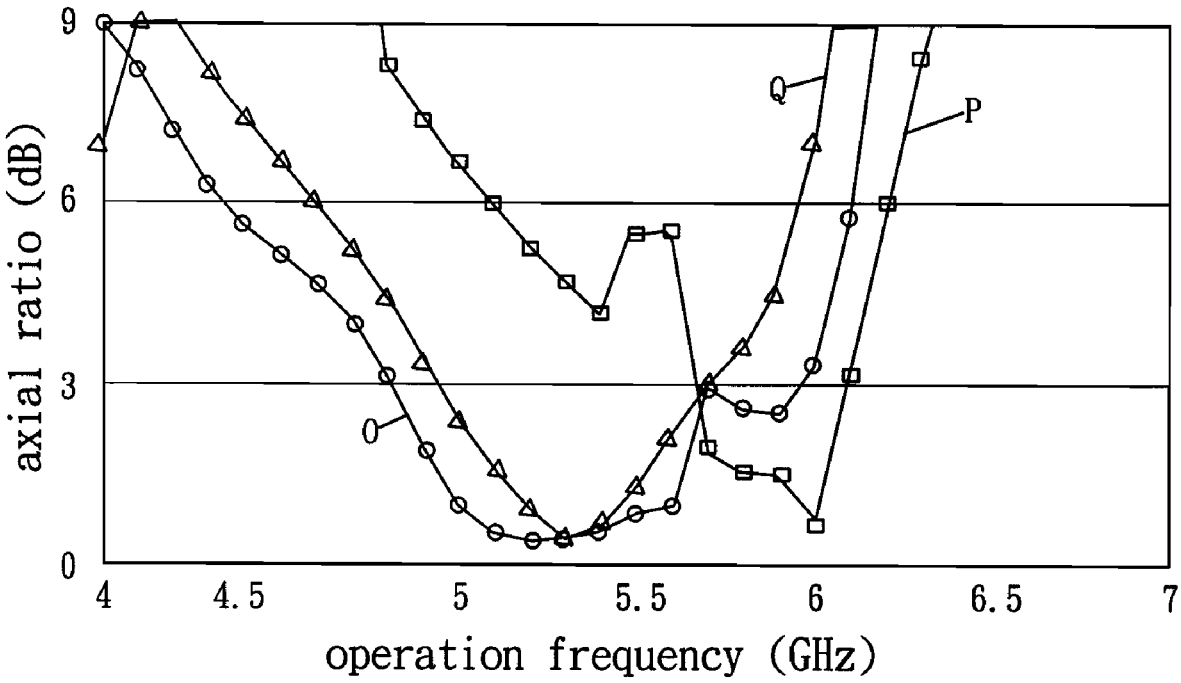
FIG. 8C is a schematic view illustrating the relation between the axial ratio on the main-lobe direction and the operation frequency of the wide band co-planar waveguide feeding circularly polarized antenna according to the first preferred embodiment, the fourth preferred embodiment, and the fifth preferred embodiment of the present invention.

FIG. 8C is a schematic view illustrating the relation between the axial ratio on the main-lobe direction and the operation frequency of the wide band co-planar waveguide feeding circularly polarized antenna according to the first preferred embodiment, the fourth preferred embodiment, and the fifth preferred embodiment of the present invention, wherein the curves in FIG. 8C are formed by the simulation performed by the IE3D program. The curve 0 in FIG. 8C illustrates the variation of the axial ratio on the main-lobe direction regarding the variation of the operation frequency of the wide band co-planar waveguide feeding circularly polarized antenna according to the first preferred embodiment of the present invention. The curve 0 in FIG. 8C illustrates the variation of the axial ratio on the main-lobe direction regarding the variation of the operation frequency of the wide band co-planar waveguide feeding circularly polarized antenna according to the first preferred embodiment of the present invention. The curve P in FIG. 8C illustrates the variation of the axial ratio on the main-lobe direction regarding the variation of the operation frequency of the wide band co-planar waveguide feeding circularly polarized antenna according to the fourth preferred embodiment of the present invention. The curve Q in FIG. 8C illustrates the variation of the axial ratio on the main-lobe direction regarding the variation of the operation frequency of the wide band co-planar waveguide feeding circularly polarized antenna according to the fifth preferred embodiment of the present invention.

As shown in 8C, although these three kinds of wide band co-planar waveguide feeding circularly polarized antenna have a first ground unit and a second ground unit of different shape and size, but since these antennas all have signal feeding units of same shape and size, the 3-dB bandwidths of the axial ratio on the main-lobe direction of these three kinds of antenna are only slightly different. In other words, the wide band co-planar waveguide feeding circularly polarized antenna of the present invention can be easily used in different kinds of application, just by slightly adjusting the size or the shape of the structure thereof. Theoretically speaking, the relation between the axial ratio on the main-lobe direction and the operation frequency of the wide band co-planar waveguide feeding circularly polarized antenna of the present invention can be determined by adjusting the sizes and the shapes of the first extended portion and the second extended portion of the signal feeding unit.

Figure 9A:
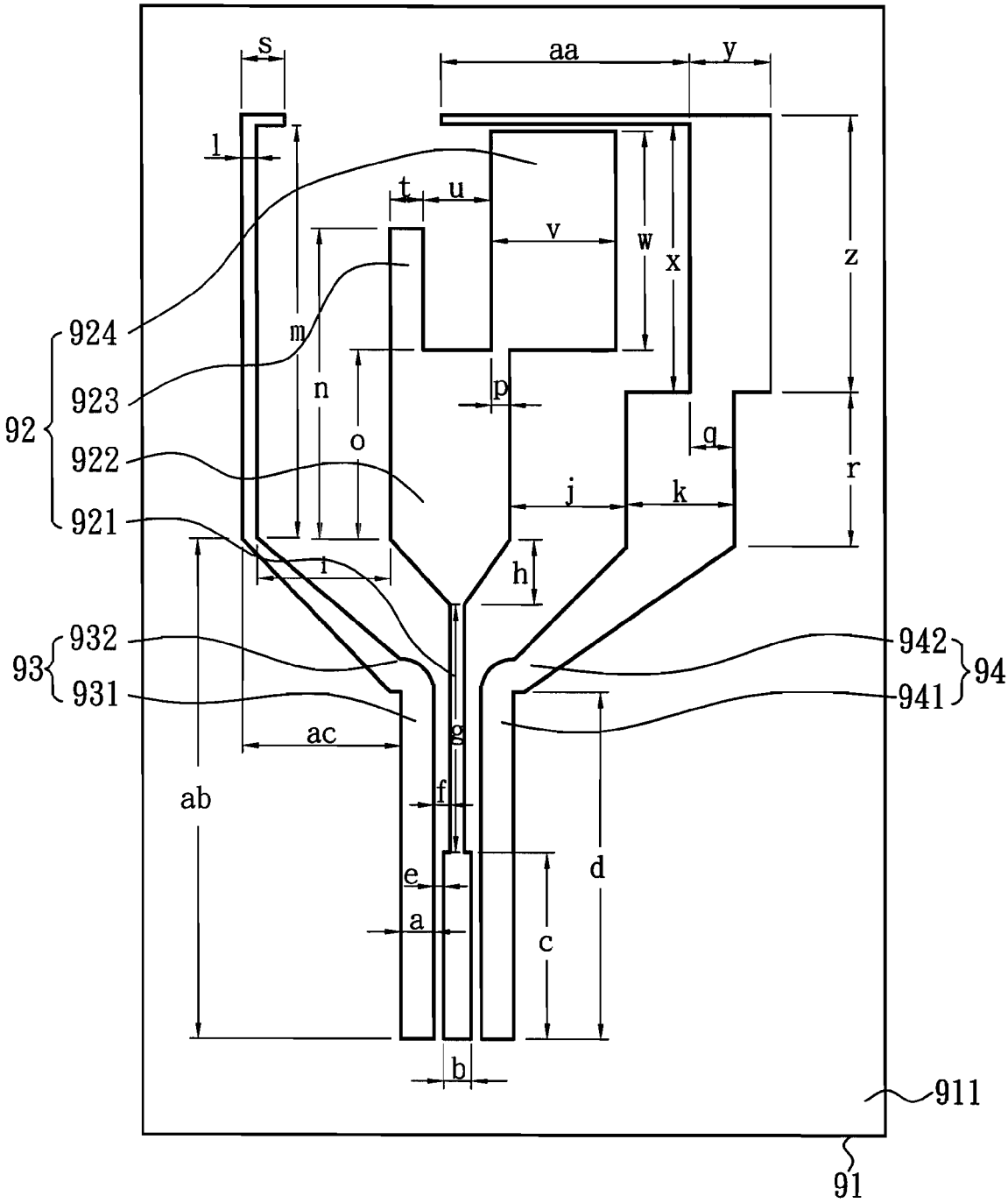
FIG. 9A is a schematic view illustrating the wide band co-planar waveguide circularly polarized antenna, according to the sixth preferred embodiment of the present invention.
Figure 9B:
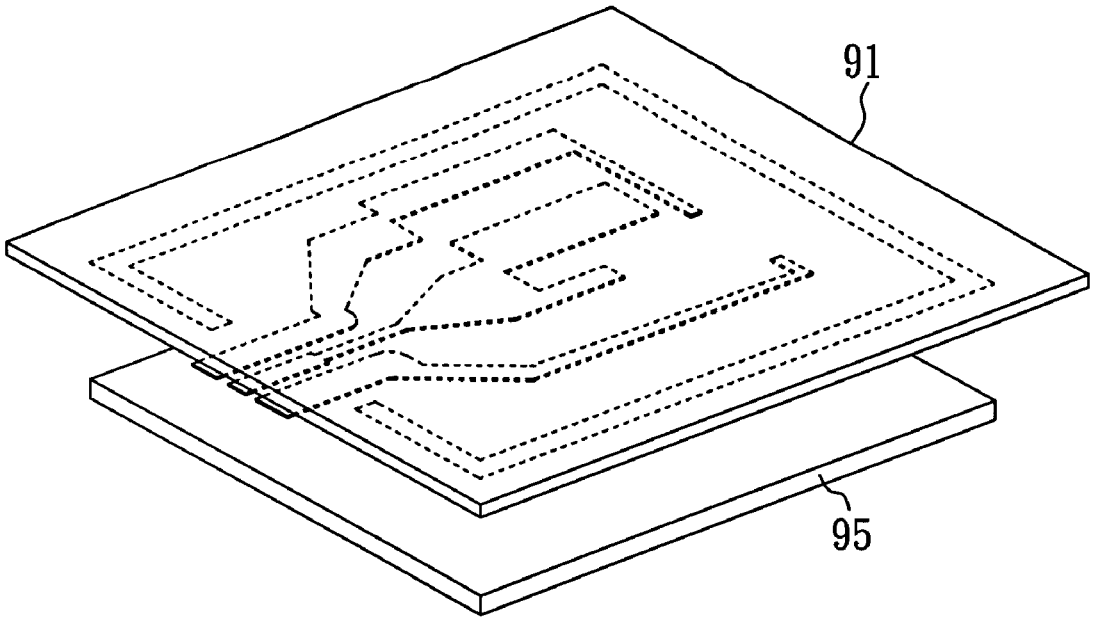
FIG. 9B is a schematic view illustrating the connecting method between the wide band co-planar waveguide circularly polarized antenna shown in FIG. 9A and a ground plate.

As shown in FIG. 9A, the wide band co-planar waveguide feeding circularly polarized antenna according to the sixth preferred embodiment comprises a substrate 91, a signal feeding unit 92, a first ground unit 93 and a second ground unit 94, wherein the signal feeding 92, the first ground unit 93 and the second ground unit 94 are respectively located on a surface 911 of the substrate 91. In the present embodiment, the substrate 91 is a silicon-based board having a dielectric constant of 3.8 and a thickness of 0.025 mm. However, in other operation condition, the substrate 91 can be made of any kind of materials. Preferably, substrate 91 can also be an FR-4 microwave substrate, a Duroid microwave substrate, a Teflon microwave substrate, a Rohacell microwave substrate, a GaAs-based microwave substrate or a ceramic-based microwave substrate.

Further, the signal feeding unit 92 comprises a feeding bar 921, a matching portion 922, a first extended portion 923, and a second extended portion 924, wherein the first extended portion 923 and the second extended portion 924 are respectively extended from the matching portion 922. The matching portion 922 is electrically connected with the feeding bar 921, the first extended portion 923, and the second extended portion 924. Besides, the feeding bar 921 is electrically connected with a signal processor (not shown). In addition, the first extended portion 923 is a vertical extended portion, and the second extended portion 924 is a parallel portion. In the present embodiment, the first extended portion 923 and the second extended portion 924 are rectangular-shaped portions, but they can have different kinds of shapes in other operation conditions, such as polygonal-shape, or square-shape.

Referring to FIG. 9A, the first ground unit 93 includes a first ground bar 931 having a first extended ground portion 932 extended from one end thereof, wherein the first extended ground portion 932 is adjacent to the first extended portion 923 on the surface 911 of the substrate 91. Besides, the second ground unit 94 includes a second ground bar 941 having a second extended ground portion 942, wherein the second extended ground portion 942 has three widths, as labeled by "k", "y", and "1" in FIG. 9A.

In addition, the feeding bar 921 is located between the first ground bar 931 and the second ground bar 941 on the surface 911 of the substrate 91, forming a so-called "co-planar feeding structure". Besides, the matching portion 922, the first extended portion 923 and the second extended portion 924 are located between the first ground portion 932 and the second ground portion 942, and as a result, the signal feeding unit 92 is located between the first ground unit 93 and the second ground unit 94. It should be noted that, although the signal feeding unit 92, the first ground unit 93 and the second ground unit 94 are made of copper in the present embodiment, the signal feeding unit 92, the first ground unit 93 and the second ground unit 94 can still be made of other kinds of metallic material, such as aluminum or gold, in other operation conditions.

Table 3 illustrates the size values represented by the labels in FIG. 9A, in order to define the size of the wide band co-planar waveguide feeding circularly polarized antenna according to the sixth preferred embodiment of the present invention.

TABLE 3

| Label | Size (μm) | Label | Size (μm) | Label | Size (μm) |
|---|---|---|---|---|---|
| a | 150 | b | 110 | c | 811.7 |
| d | 1497 | e | 40 | f | 70 |
| g | 1178.5 | h | 298.8 | i | 565.3 |
| j | 477 | k | 455.7 | l | 65.5 |
| m | 1808 | n | 1407.8 | o | 820.3 |
| p | 85.9 | q | 190.1 | r | 611.8 |
| s | 645.4 | t | 144.8 | u | 292.3 |
| v | 529.5 | w | 945.9 | x | 1172.8 |
| y | 411.4 | z | 1203 | aa | 1369.2 |
| ab | 2157 | ac | 680.3 | | |

Finally, other than the structure shown in FIG. 9A, the wide band co-planar waveguide feeding circularly polarized antenna further comprises a ground plate 95, wherein the signal feeding unit 92, the first ground unit 93 and the second ground unit 94 are located between the substrate 91 and the ground plate 95. Therefore, the wide band co-planar waveguide feeding circularly polarized antenna according to the sixth preferred embodiment can only transmit or receive a high frequency signal by one-way, i.e., being operated as a one-way radiation unit.

In addition, the distance between the substrate 91 and the ground plate 95 is 0.5 mm, which is about 0.1 times to the wavelength of the high frequency signal being transmitted and received by the wide band co-planar waveguide feeding circularly polarized antenna according to the sixth preferred embodiment. Besides, the central frequency of the high frequency signal is about 60 GHz. It should be noted that, in different operation environments, the distance between the substrate 91 and the ground plate 95 can be ranged from 0.05 times to 0.2 times to the wavelength of the high frequency signal being transmitted and received by the wide band co-planar waveguide feeding circularly polarized antenna according to the sixth preferred embodiment. Although in the present embodiment, the ground plate 95 is made of copper, the ground plate 95 can still be made of any kind of metallic materials in other operation conditions, such as aluminum or gold.

Figure 9C:
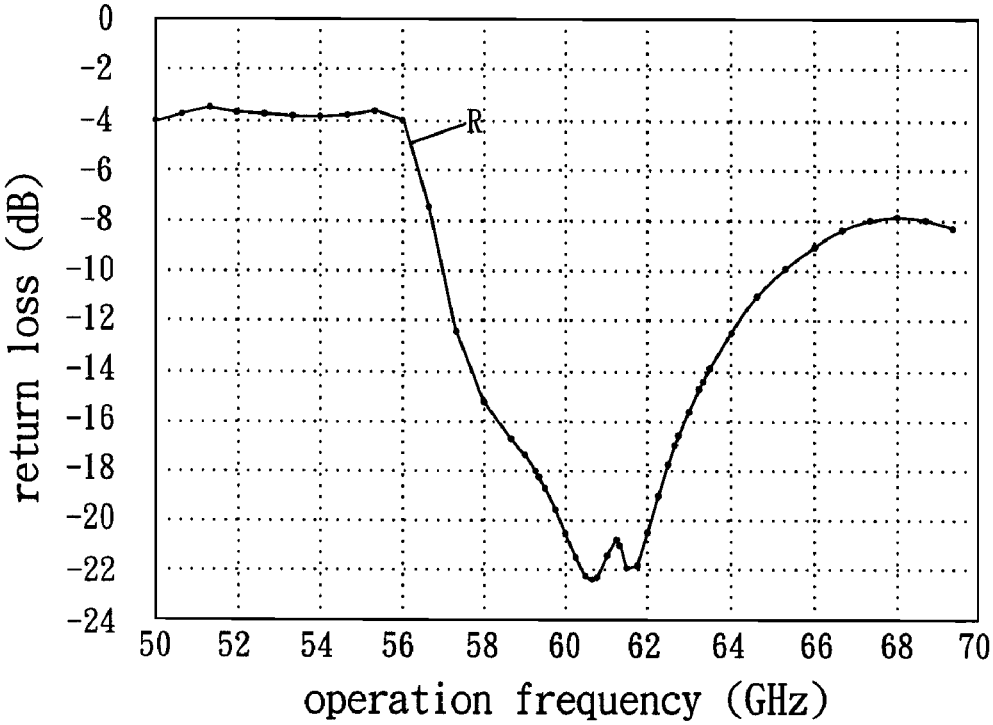
FIG. 9C is a schematic view illustrates the relation between the return loss on the main-lobe direction and the operation frequency of the wide band co-planar waveguide feeding circularly polarized antenna according to the sixth preferred embodiment of the present invention.

FIG. 9C is a schematic view illustrates the relation between the return loss on the main-lobe direction and the operation frequency of the wide band co-planar waveguide feeding circularly polarized antenna according to the sixth preferred embodiment of the present invention, wherein curve R is formed by the simulation performed by the IE3D program. As shown in FIG. 9C, the loss return of the wide band co-planar waveguide feeding circularly polarized antenna according to the sixth preferred embodiment is below −10 dB, while the operation frequency of the wide band co-planar waveguide feeding circularly polarized antenna is in the frequency band ranging from 57 GHz to 65.5 GHz. Therefore, the 10-dB bandwidth of the loss return of the wide band co-planar waveguide feeding circularly polarized antenna according to the sixth preferred embodiment is about 8.5 GHz.

Figure 9D:
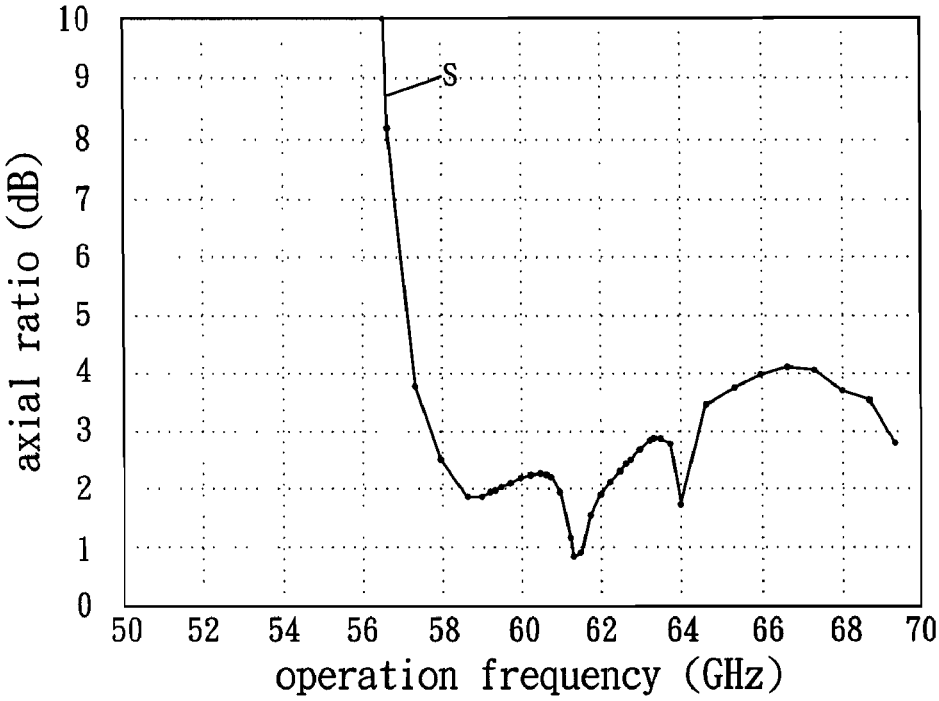
FIG. 9D is a schematic view illustrating the relation between the axial ratio on the main-lobe direction and the operation frequency of the wide band co-planar waveguide feeding circularly polarized antenna according to the sixth preferred embodiment of the invention.

FIG. 9D is a schematic view illustrating the relation between the axial ratio on the main-lobe direction and the operation frequency of the wide band co-planar waveguide feeding circularly polarized antenna according to the sixth preferred embodiment of the invention, wherein curve S is formed by the simulation performed by the IE3D program. As shown in FIG. 9D, the axial ratio on the main-lobe direction of the wide band co-planar waveguide feeding circularly polarized antenna according to the sixth preferred embodiment is below 3 dB, while the operation frequency of the wide band co-planar waveguide feeding circularly polarized antenna is in the frequency band ranging from 57.5 GHz to 64.5 GHz. Therefore, the 3-dB bandwidth of the axial ratio of the wide band co-planar waveguide feeding circularly polarized antenna according to the sixth preferred embodiment is about 7 GHz.

Figure 9E:
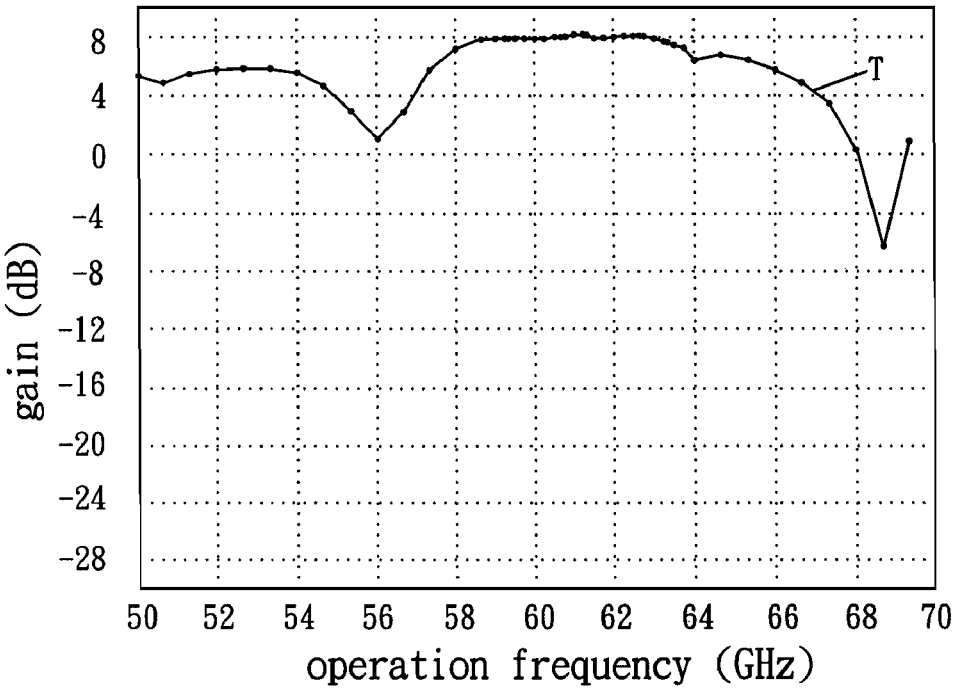
FIG. 9E is a schematic view illustrating the relation between the gain on the main-lobe direction and the operation frequency of the wide band co-planar waveguide feeding circularly polarized antenna according to the sixth preferred embodiment of the present invention.

FIG. 9E is a schematic view illustrating the relation between the gain on the main-lobe direction and the operation frequency of the wide band co-planar waveguide feeding circularly polarized antenna according to the sixth preferred embodiment of the present invention, wherein curve T is formed by the simulation performed by the IE3D program. As shown in FIG. 9E, the gain on the main-lobe direction of the wide band co-planar waveguide feeding circularly polarized antenna according to the sixth preferred embodiment is over 2 dB, while the operation frequency of the wide band co-planar waveguide feeding circularly polarized antenna is in the frequency band ranging from 57 GHz to 68 GHz.

With reference to FIG. 9C, FIG. 9D, and FIG. 9E, the wide band co-planar waveguide feeding circularly polarized antenna according to the sixth preferred embodiment can receive and transmit a circularly polarized high frequency signal in the frequency band ranging from 59 GHz to 64 GHz.

From the abovementioned, as the wide band co-planar waveguide circularly polarized antenna of the present invention is operated as a one-way radiation unit, the distance between the ground plate and the antenna body thereof is 0.1 times of the wavelength of the signal transmitted or received by the antenna, which is smaller than the distance between the ground plate and the antenna body of a conventional antenna. Therefore, while the antenna of the present invention is operated at a millimeter frequency band and as a one-way radiation unit, the size of the antenna can be further reduced so as to be packaged on a printed circuit board, along with a signal processor. In addition, the wide band co-planar waveguide feeding circularly polarized antenna of the present invention can be designed to transmit or receive a circularly polarized high frequency signal at two different frequency bands, such as the one ranging from 5.2 GHz to 5.8 GHz (the present RF communication band), and the one ranging from 59 GHz to 64 GHz (the future RF communication band). Consequently, without changing its structure significantly, the wide band co-planar waveguide circularly polarized antenna of the present invention can operate both at the present RF communication band and the future RF communication band.

Although the present invention has been explained in relation to its preferred embodiment, it is to be understood that many other possible modifications and variations can be made without departing from the scope of the invention as hereinafter claimed.

What is claimed is:

1. A wide band co-planar waveguide feeding circularly polarized antenna, comprising:

a substrate having a surface;

a signal feeding unit located on the surface and comprising a feeding bar, a matching portion, a first extended portion, and a second extended portion;

a first ground unit located on the surface and having a first ground bar; and a second ground unit located on the surface and having a second ground bar; and a ring portion located on the surface of the substrate, and the feeding unit, the first ground unit and the second ground unit being surrounded by the ring portion;

wherein, the first extended portion and the second extended portion are respectively extended from the matching portion; the matching portion is electrically connected with the feeding bar, the first extended portion and the second extended portion; and the feeding bar is located between the first ground bar and the second ground bar.

2. The antenna as claimed in claim 1, further comprising a ground plate, and the signal feeding unit, the first ground unit and the second ground unit being located opposite to the ground plate.

3. The antenna as claimed in claim 2, wherein the ground plate is made of metallic material.

4. The antenna as claimed in claim 2, wherein the antenna transmits and receives a high frequency signal at a first predetermined frequency band, and the first predetermined frequency band ranges from 5.2 GHz to 5.8 GHz.

5. The antenna as claimed in claim 4, wherein the antenna transmits and receives a high frequency signal at a second predetermined frequency band, and the second predetermined frequency band ranges from 59 GHz to 64 GHz.

6. The antenna as claimed in claim 5, wherein a distance between the ground plate and the substrate ranges from 0.05 times to 0.2 times of the wavelength of the high frequency signal.

7. The antenna as claimed in claim 1, wherein the ring portion is a rectangular ring having an opening.

8. The antenna as claimed in claim 1, wherein the first extended portion is a vertical extended portion, and the second extended portion is a parallel extended portion.

9. The antenna as claimed in claim 8, wherein the vertical extended portion is a rectangular-shaped portion.

10. The antenna as claimed in claim 8, wherein the parallel extended portion is a rectangular-shaped portion.

11. The antenna as claimed in claim 8, wherein a first extended ground portion is further extended from one end of the first ground bar.

12. The antenna as claimed in claim 11, wherein the first extended ground portion is adjacent to the vertical extended portion on the surface of the substrate.

13. The antenna as claimed in claim 11, wherein the first extended ground portion is adjacent to the parallel extended portion on the surface of the substrate.

14. The antenna as claimed in claim 11, wherein a second extended ground portion is further extended from one end of the second ground bar, and the first extended ground portion and the second extended ground portion have the same shape.

15. The antenna as claimed in claim 1, wherein both the first extended portion and second extended portion are vertical extended portions and rectangular-shaped portions.

16. The antenna as claimed in claim 15, wherein a first extended ground portion is further extended from one end of the first ground bar, and a second extended ground portion is further extended from one end of the second ground bar.

17. The antenna as claimed in claim 16, the second extended ground portion has at least two widths.

18. The antenna as claimed in claim 1, wherein the substrate is an FR-4 microwave substrate.

19. The antenna as claimed in claim 1, wherein the signal feeding unit, the first ground unit, and the second ground unit are made of metallic material.

* * * * *